United States Patent [19]

Takahashi et al.

[11] Patent Number: 4,640,083

[45] Date of Patent: Feb. 3, 1987

[54] APPARATUS FOR PRODUCING BAGS AND PACKING ARTICLES THEREIN

[75] Inventors: Shizuo Takahashi, Abiko; Kiyoshi Yamashita, Toride, both of Japan

[73] Assignee: Tokyo Automatic Machinery Works, Ltd., Tokyo, Japan

[21] Appl. No.: 615,724

[22] Filed: May 31, 1984

[30] Foreign Application Priority Data

May 31, 1983 [JP] Japan ..... 58-82144[U]
May 31, 1983 [JP] Japan ..... 58-82145[U]

[51] Int. Cl.[4] ..... B65B 9/06

[52] U.S. Cl. ..... 53/551; 17/41; 53/512; 53/554; 141/285

[58] Field of Search ..... 53/551, 552, 554, 510, 53/512, 451; 141/285, 392; 17/41

[56] References Cited

U.S. PATENT DOCUMENTS

| | | | |
|---|---|---|---|
| 826,216 | 7/1906 | Asbury | 17/41 |
| 826,277 | 7/1906 | Rump | 17/41 |
| 990,547 | 4/1911 | Gunuskey | 17/41 |
| 2,432,373 | 12/1947 | Bleam et al. | 53/551 |
| 2,564,969 | 8/1951 | Goldberg | 53/434 |
| 2,984,172 | 5/1961 | Roberts et al. | 53/512 |
| 3,040,490 | 6/1962 | Virta | 53/551 |
| 3,137,328 | 6/1964 | Swenson et al. | 141/285 |
| 4,407,108 | 10/1983 | Craig | 53/551 |
| 4,501,109 | 2/1985 | Monsees | 53/551 |

*Primary Examiner*—John Sipos
*Assistant Examiner*—Donald R. Studebaker
*Attorney, Agent, or Firm*—Watson, Cole, Grindle & Watson

[57] ABSTRACT

An apparatus for forming bags from a packing film and then filling the bags with bulky solid or powdery materials includes a bag-making cylinder which has air-removing grooves in its outer periphery for removing air in the bags when the materials are collectively filled into the bags, thus resulting in a constant and high speed packing operation.

1 Claim, 6 Drawing Figures

APPARATUS FOR PRODUCING BAGS AND PACKING ARTICLES THEREIN

BACKGROUND OF THE INVENTION

1. Field of the Invention

This invention relates to an apparatus for producing bags and packing articles therein in which a packing film is introduced into and passes through a cylindrical body for producing bags to form a vertically continuous packing bags, and then articles are filled through the cylindrical body into the packing bags.

2. Description of the Prior Art

The noted type of packing apparatus is disclosed in U.S. Pat. Nos. 2,969,627 and 4,171,605, British Pat. No. 827,792, and Japanese Laid-Open Pat. No. 56-32203. However, these disclosed packing apparatuses as disclosed in the above patents do not include means for removing air from the forward packing bags. As a result, when a large amount of articles is collectively filled into the bags so as to correspond to a high speed packing, air in the bags cannot escape therefrom, and there occurs back flow of air from the bags to the cylindrical body for producing the bags, thereby interfering with the proper filling of the articles, and sometimes breaking the bags, thereby scattering the articles in the bags.

To cope with the above defects, conventionally a small amount of articles as divided is sometimes filled into the bags with the air in the bags escaping through spacings between the articles. However, this process requires a long time for dropping the articles and filling same. Further, since the spacings between the articles as filled are relatively large, it is necessary to vibrate the bags after filling the articles therein so as to reduce the spacings by a vibrating device for a certain period of time. Thus, a high speed packing has not been achieved by the prior art apparatus.

SUMMARY OF THE INVENTION

Accordingly, it is an object of the present invention to achieve a high speed packing by providing air-removing passages in a cylindrical body for producing the bags to collectively fill the articles with the spacings between the articles reduced.

It is another object of the present invention to provide a simple packing apparatus having the air-removing passages in the cylindrical body for producing the bags.

As is described above, the present invention is characterized in that there is provided air-removing passages extending along the axis of the cylindrical body on the outer periphery thereof.

DESCRIPTION OF THE PREFERRED EMBODIMENTS

Figure 1:
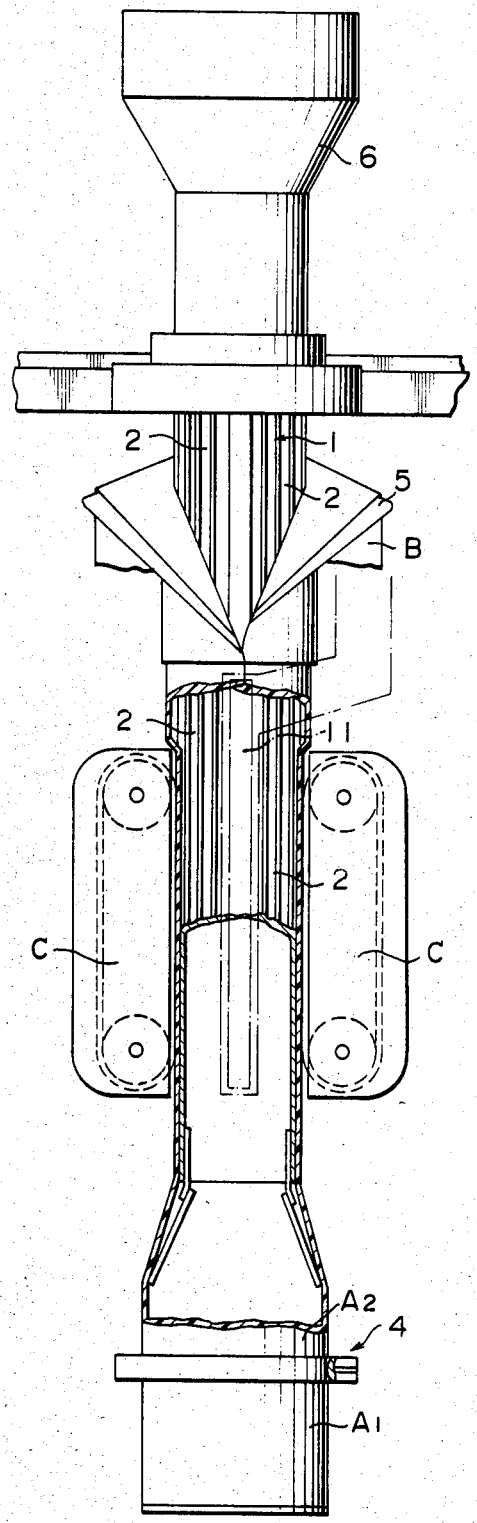
FIG. 1 is a partially sectioned, elevational view of the apparatus for producing bags and packing articles therein according to the present invention.
Figure 2:
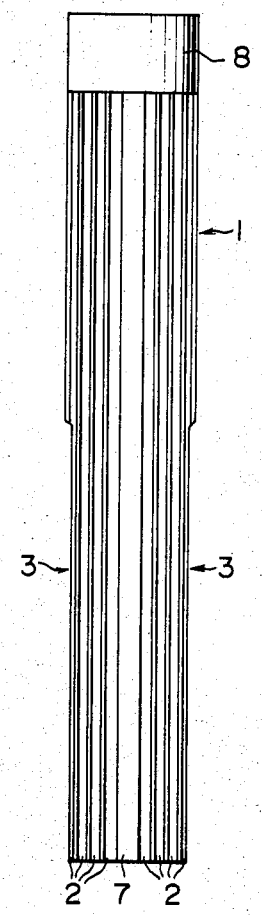
FIG. 2 is an elevational view of the apparatus according to the present invention.
Figure 3:
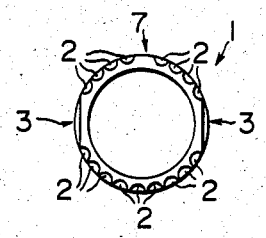
FIG. 3 is a bottom plan view of FIG. 2.

Referring to FIGS. 1 to 3, reference numeral 1 designates a cylindrical body or bag-making cylinder for allowing a packing film B to be introduced therefrom and pass therethrough and forming a cylindrical packing film. A vertical seal device 11 for effecting a vertical seal of the packing film B is provided in the vicinity of the cylindrical body 1. The sealing of the packing film B is accomplished on the surface 7 of the cylindrical body (see FIGS. 2 and 3).

A feed belt C for downwardly feeding the packing film is provided on two sides of the cylindrical body 1, and a lateral seal device 4 having a cutter is provided at a lower portion of the cylindrical body 1 so as to allow an opening and closing operation. The lateral seal device 4 serves to effect a lateral seal of an opening portion of a bag $A_1$ and a bottom portion of a bag $A_2$, and to separate the bag $A_1$ from the bag $A_2$.

A sailor 5 for forming the packing film B is provided at an upper portion of the cylindrical body 1, and a hopper 6 for filling articles is connected to the upper portion of the cylindrical body 1.

Next, referring particularly to FIGS. 2 and 3, the cylindrical body 1 is formed in a cylindrical shape except for the flat cut-away portions 3 at a lower portion of the cylindrical body in opposed relation with each other which abut against the feed belts C. Air-removing grooves 2 of sectional semicircular shape extend along the axis of the cylindrical body except that there remains a cylindrical portion 8 for installation. The number of air-removing grooves 2 is appropriate. In a preferred embodiment, as an increased number of the grooves 2 causes a large amount of air to be removed, the grooves 2 are provided along all the areas of the cylindrical body except the flat cut-away portions 3 and a portion to be brought into contact with the vertical seal device.

With this structure, since the air-removing grooves 2 are opened to the atmosphere at an upper portion of the cylindrical body 1 above the sailor 5, the air contained in the bag $A_1$ may be removed through the air-removing grooves 2 to the atmosphere.

In operation, when articles as preliminarily collected are fed from the hopper 6 into the bag $A_1$, the air in the bag $A_1$ is delivered through the air-removing grooves 2.

When the articles are filled into the bag $A_1$, the lateral seal device 4 is operated to close and seal an opening of the bag $A_1$ and a bottom of the bag $A_2$. Then the bag $A_1$ is separated from the bag $A_2$ by the lateral seal device 4, which is in turn operated to open.

Then, the feed belts C are driven to lower the bag $A_2$ to the position of the bag $A_1$, and thereafter the same operation as above is repeated.

As is described above, when the articles are filled into the bags, the air in the bag $A_1$ rises through the grooves 2 along the cylindrical body 1, and then is delivered from an outer periphery of the upper portion of the cylindrical body to the atmosphere. Accordingly, the articles may be collectively filled into the bags, thereby reducing the time for filling the articles, and thereby attaining a high speed packing operation. Further, owing to such a collective filling of the articles, the spacings between the articles as filled in the bag $A_1$ more are reduced to make the bag $A_1$ compact. Therefore, a vertical length of the bag $A_1$, that is, the length between each lateral seal, may be maintained at a predetermined length.

Figure 4:
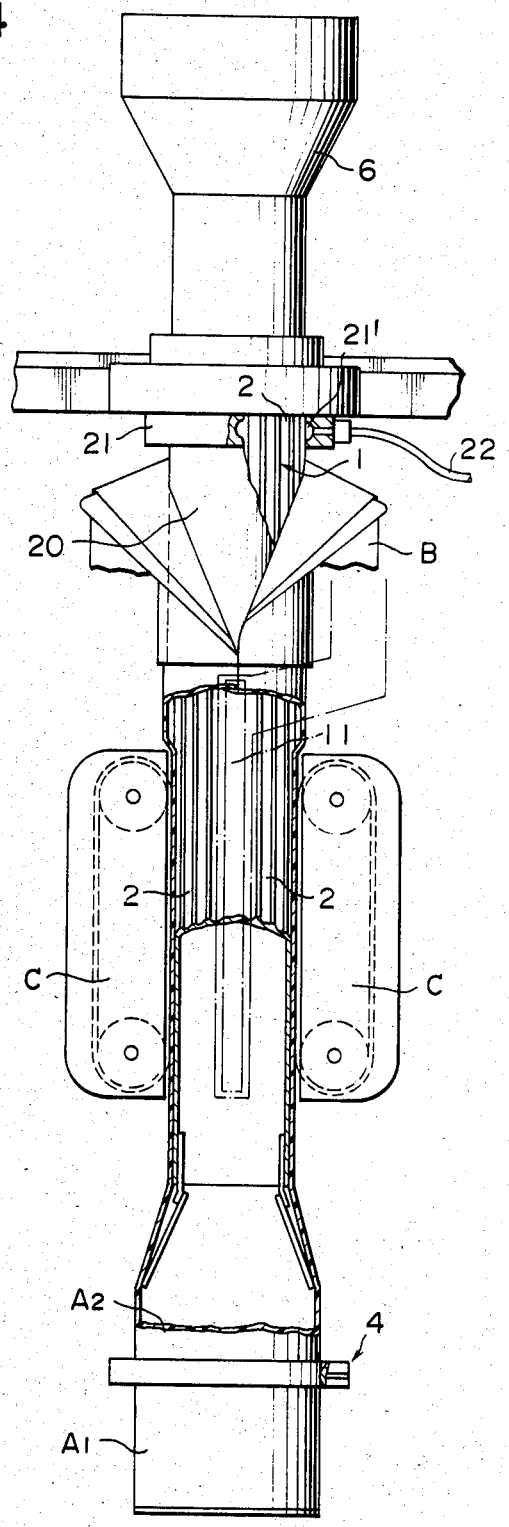
FIG. 4 is a partially sectioned, elevational view of another embodiment.

Referring next to FIG. 4 which shows another embodiment, the same members as in the previous embodiment are indicated by the same numerals, and the related explanation will be omitted.

As shown in FIG. 4, a thin cylindrical plate member 20 of synthetic resin is fitted into the sailor 5 of the cylindrical body 1, and an annular member 21 having a ring groove 21' is fitted to the upper end of the cylindrical body 1, which groove 21' is in communication with an air suction pipe 22, whereby all the air from the air-removing grooves 2 is sucked through the ring groove 21' to the air suction pipe 22. In this embodiment, air may be continuously sucked, or may be intermittently sucked in correspondence with timing of filling of the articles.

As is described above in connection with FIG. 4, when the articles are filled into the bag, the air in the bag $A_1$ is forcibly sucked through the air-removing grooves 2, the ring groove 21' to the air suction pipe 22, and accordingly the air in the bag $A_1$ is effectively removed. As a result, the articles may be collectively filled into the bag with no problem.

Figure 5:
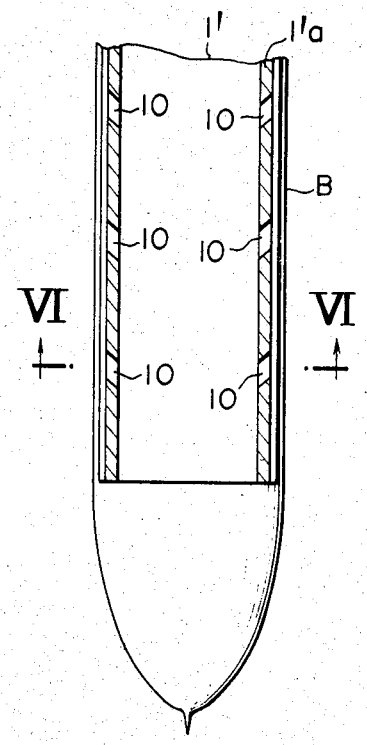
FIG. 5 is a vertically sectional view of the essential part of the apparatus of a modified embodiment.
Figure 6:
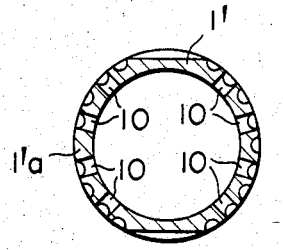
FIG. 6 is a cross-sectional view taken along the line VI—VI in FIG. 5.

FIGS. 5 and 6 show a modified embodiment of a cylindrical body according to the present invention, wherein there is formed a plurality of through-holes 10 passing through a wall 1'a of a cylindrical body 1' for connecting the interior of the cylindrical body with the air-removing grooves 2. Preferably, the through-holes 10 are upwardly inclined to open into the grooves 2 as shown in FIG. 5 for effective air flow.

In this embodiment, when the articles are filled into the bag, the air in the bag $A_1$ effectively flows through the interior of the cylindrical body 1' and the through-hole 10 to the air-removing grooves 2.

The cylindrical body 1' as described above may be used in the previous embodiments of FIGS. 1 and 4 by substituting it for the cylindrical body 1.

We claim:

1. In an apparatus for forming and filling a series of bags, said apparatus including a vertical bag-making cylinder around which a film can be wrapped to form a tube as the film passes along the length of said bag-making cylinder from its upper end to its lower end and through the interior of which the articles intended to be contained in each bag can flow, a sealing means sealingly located adjacent the lower end of said bag-making cylinder for closing the open top of a downstream bag and closing the bottom of an adjacent upstream bag, and air removal means for removing air from within a bag which contains articles prior to the closing of its open top, the improvement wherein said air removal means comprises a plurality of parallel grooves in the outer periphery of said bag-making cylinder which extend in parallel with a central axis thereof from its lower end toward its upper end; a plurality of upwardly inclined holes in said bag-making cylinder which extend from its interior to each of said plurality of parallel grooves; an annular element surrounding said bag-making cylinder near its upper end, said annular element including an annular groove therein which communicates with said plurality of parallel grooves in the outer periphery of said bag-making cylinder; and a suction pipe connected to said annular element and in communication with said annular groove; said suction pipe enabling air to be sucked out of each bag into the interior of said bag-making cylinder, then through said holes into said plurality of parallel grooves in the outer periphery of said bag-making cylinder, along said parallel grooves and into said annular groove in said annular element, and then into said suction pipe.

* * * * *